US005924573A

United States Patent [19]

Piraneo et al.

[11] Patent Number: 5,924,573

[45] Date of Patent: Jul. 20, 1999

[54] EASY DISPENSE PLASTIC BAG DISPENSING SYSTEM

[75] Inventors: Carmelo Piraneo, Villa Park; Salim Bana, Orange; Gary A. Woodruff, Lawndale, all of Calif.; Richard S. Petrie, Pickerington, Ohio

[73] Assignee: Orange Plastics, Inc., Compton, Calif.

[21] Appl. No.: 08/785,859

[22] Filed: Jan. 20, 1997

[51] Int. Cl.[6] ..... B65D 30/08; B65D 33/00

[52] U.S. Cl. ..... 206/554; 383/9; 383/37; 383/207

[58] Field of Search ..... 206/554; 383/9, 383/37, 207, 209, 35

[56] References Cited

U.S. PATENT DOCUMENTS

| | | | |
|---|---|---|---|
| 3,101,887 | 8/1963 | Kugler | 383/9 |
| 3,285,407 | 11/1966 | Abramson | 206/554 |
| 3,385,428 | 5/1968 | Kugler | 206/554 |
| 3,616,991 | 11/1971 | Beck | 383/207 |
| 3,909,582 | 9/1975 | Bowen | 383/209 |
| 4,046,257 | 9/1977 | Lehmacher | 206/554 |
| 4,480,750 | 11/1984 | Dancy | 206/554 |
| 4,769,125 | 9/1988 | Roen et al. | 206/554 |
| 4,769,126 | 9/1988 | Roen et al. | 206/554 |
| 4,796,759 | 1/1989 | Schisler | 206/554 |
| 4,854,451 | 8/1989 | Jensen | 383/9 |
| 5,213,145 | 5/1993 | Huang et al. | 141/391 |
| 5,248,040 | 9/1993 | DeMatteis et al. | 206/554 |
| 5,497,884 | 3/1996 | DeMatteis et al. | 206/554 |
| 5,626,550 | 5/1997 | Amero et al. | 493/204 |

FOREIGN PATENT DOCUMENTS

| | | | |
|---|---|---|---|
| 0 596 747 A1 | 1/1994 | European Pat. Off. . | |
| 596747 | 5/1994 | European Pat. Off. | 383/208 |
| 2695107 | 3/1994 | France | 383/37 |
| 3703757 | 8/1988 | Germany | 383/37 |
| 1016676 | 1/1966 | United Kingdom | 206/554 |

*Primary Examiner*—Paul T. Sewell
*Assistant Examiner*—Anthony Stashick
*Attorney, Agent, or Firm*—Sheldon & Mak

[57] ABSTRACT

A bag dispensing system for suspending and dispensing plastic bags such as T-shirt bags and merchandise bags comprises a bag dispenser constructed to be mounted underneath counters of checkouts. The bag dispensing system comprises relatively short bag engaging hooks which are inserted through apertures formed in T-shirt bags. The apertures are positioned to enable downward removal of the T-shirt bags from the bag dispenser by applying a small downward force. The bag dispensing system further comprises removably detachable bag supporting members to simultaneously support different sized merchandise bags. Merchandise bag engaging hooks provided on the bag dispenser, and slits formed through the merchandise bag panels and gussets, assist in the opening of the bags during dispensing.

20 Claims, 9 Drawing Sheets

FIG. 1
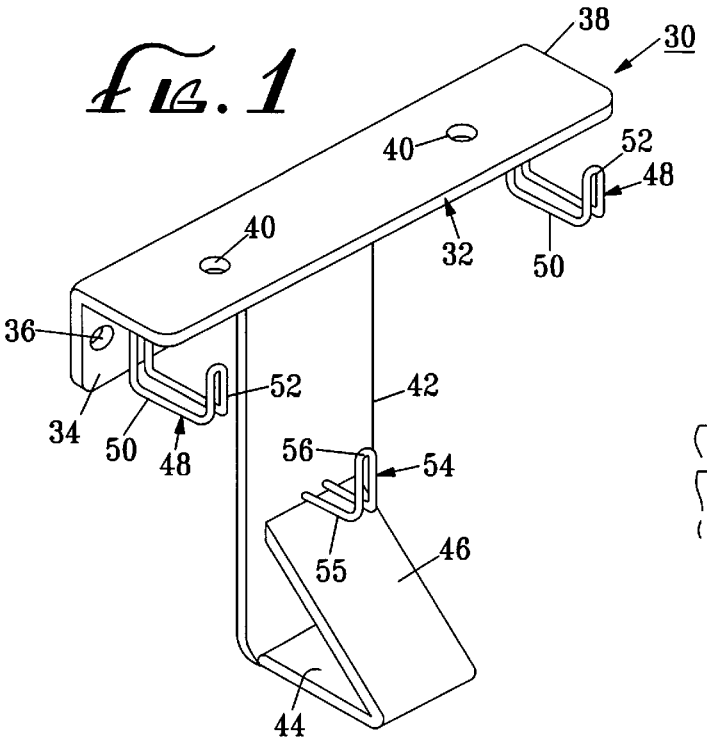
FIG. 2
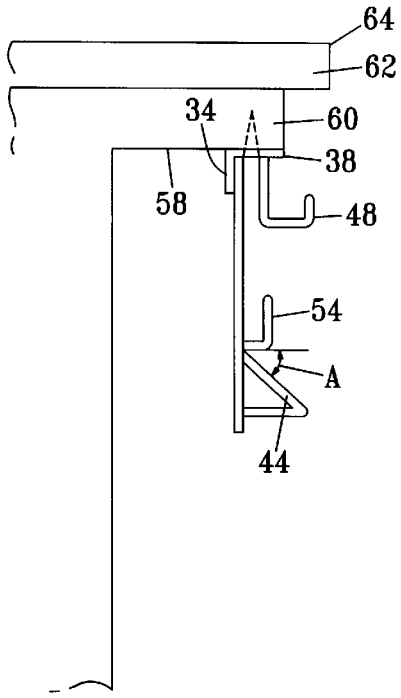
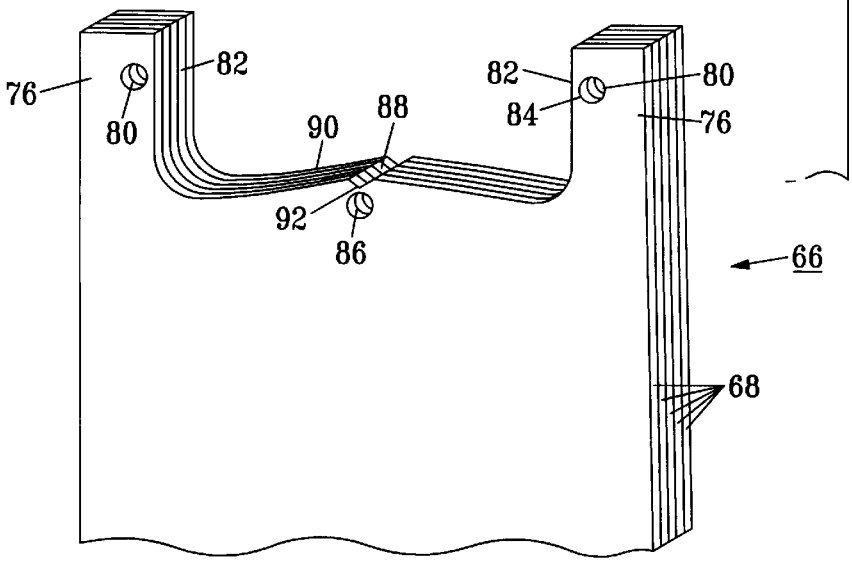
FIG. 3

EASY DISPENSE PLASTIC BAG DISPENSING SYSTEM

BACKGROUND

The invention is directed to the field of bag dispensers and, more particularly, to plastic bags and bag dispensers for dispensing plastic bags.

In grocery stores and discount stores, customer purchases are typically loaded into plastic bags provided in stacked bundles known as bag packs. The bundles consist of a plurality of individual bags stacked into a pack and secured together using small welds or adhesives. The bags are typically either merchandise bags or T-shirt bags.

To expedite and simplify the bagging operation, the bag packs are commonly suspended on a metal supporting rack. Known merchandise bags comprise horizontal lines of weakness. These bags are typically supported vertically on supporting racks. The bags are removed from the supporting racks by severing the lines of weakness. For dispensing T-shirt bags, known supporting racks include laterally spaced support arms and a central hook located between the arms. The support arms extend through laterally spaced apertures formed in the handles of the bags, and the central hook extends through a central aperture formed in the bags. The bags are individually loaded and then pulled off of the support arms, before and during the bagging operation.

In grocery stores, the supporting racks are typically located at the end of checkouts. The supporting racks are portable so as to be selectively positionable on the checkout counter, or the racks are fixedly mounted to the checkout. Known racks are commonly fixedly mounted at ends of checkouts such that the support arms extend outwardly away from the checkouts. A disadvantage of these racks is that the arms are an obstruction and a potential source of injury to customers and employees.

Most known racks also have the disadvantage of being constructed for use with only one size of bag. Racks are known for dispensing bags only of certain lengths. Consequently, the most appropriate sized bag for loading a purchase is often not available to the bagger. The bag size may be too small, resulting in the purchased items having to be loaded into several bags that are difficult for the customer to carry. If the bag size is too large, a large bag is wasted for purchases that require only a small bag. Plastic bags are a petroleum product and sold on a weight basis. Accordingly, the potential cost savings for using smaller bags instead of larger bags in appropriate situations is substantial.

Another disadvantage of most known racks is that the support arms are fixed at one position on the rack. The particular position at which the arms are fixed can be important. In some cases it is only possible to mount the rack at a certain location at the checkout, and the arms may be improperly positioned for that location. For example, the suspended bags may be difficult to reach or the arms may obstruct customer traffic.

Most known racks also do not urge the suspended bags open during removal from supporting racks to ease the loading of items into the removed bags. Plastic bags have a tendency to stay closed due to static charges on the bags. Consequently, the bagger must often struggle to open the bags before being able to load items into them. This problem slows the bagging operation and can cause customer delays at checkouts. This problem has become especially important today with an increased number of senior citizens, having diminished hand dexterity, being employed as baggers, and due to the increased number of self-service checkouts at which inexperienced customers bag their own purchases.

Thus, in view of the above-described disadvantages of known dispensers, there is a need for an improved bag dispensing system for suspending and dispensing plastic bags that (i) includes no long laterally spaced arms that are an obstruction to persons in stores; (ii) enables the selective dispensing of different sized bags at a single location; (iii) provides for adjustable positioning of the bags on the bag dispenser; and (iv) urges the suspended bags open during removal from the dispensing device to expedite loading of the bags.

SUMMARY

The present invention provides an improved supporting and dispensing system for plastic bags and, particularly, T-shirt bags and merchandise bags that satisfies the above-described needs. More specifically, the dispensing system (i) urges bags open during removal from the dispensing device to enable items to be easily loaded; (ii) is compact and includes no long supporting arms that can obstruct persons; (iii) provides for the selective dispensing of different sized bags from a single dispenser; and (iv) provides for adjustable positioning of the suspended bags.

The bag dispenser particularly suitable for use with T-shirt bags comprises a mounting portion for fixedly attaching to a surface, and a pair of laterally spaced handle engaging elements protruding from the mounting portion. The handle engaging elements are each sized to be inserted through an aperture formed in one of the handles of a T-shirt bag. A panel engaging element is provided on the mounting portion between the handle engaging elements for inserting through a hole formed through the front and rear panels of the T-shirt bag to suspend the T-shirt bag from the bag dispenser. The bag engaging elements each have a shaft and an upstanding distal end on the shaft for maintaining the T-shirt bags on the shaft.

An intermediate member can be provided on the mounting portion. The intermediate member extends downwardly from the mounting portion intermediate the handle engaging elements. The intermediate member includes a support wall extending forwardly, downwardly at an acute angle relative to the horizontal. The support wall contacts the rear panel of the rearmost T-shirt bag suspended from the bag dispenser.

The shafts of the handle engaging elements and the panel engaging element each typically have a length of less than about 2 in. This short length gives the bag dispenser a compact construction and enables the bag dispenser to be mounted below counters without being an obstruction.

The mounting portion can have a first portion defining at least one first hole therethrough, and a second portion oriented at an angle relative to the first portion defining at least one second hole therethrough. The first hole receives a first fastener to selectively attach the mounting portion to the surface in a first orientation of the bag dispenser, and the second hole receives a second fastener to selectively attach the mounting portion to the surface in a second orientation of the bag dispenser.

The T-shirt bags according to the present invention comprise a front panel, and a rear panel connected to the front panel by gussets so as to define an open top. The hole is formed through the front panel and the rear panel proximate to the open top. A pair of laterally spaced handles project upwardly from the open top. The handles each have an inner edge and an aperture is formed through each handle proximate to the inner edge. The hole is disposed laterally between the apertures proximate to the open top.

The apertures are typically spaced less than about ¼ in. from the inner edge, and the hole is typically spaced less than about ¼ in. from the open top. This positioning of the apertures and the hole enable the T-shirt bags to be easily removed from the bag dispenser by applying a small downward force.

The front panel and the rear panel of the T-shirt bags can each comprise a first layer having an exterior surface and a second layer on the first layer. The first layer is composed of a first plastic material and the second layer is composed of a second plastic material. The first plastic material has a first tear strength, a first tensile strength and preferably a sticky exterior texture. The second material has a second tear strength and a second tensile strength. The first tear strength is greater than the second tear strength, and the second tensile strength is greater than the first tensile strength, such that the T-shirt bag has good tear strength and tensile strength. The T-shirt bags are typically provided in a bag pack consisting of a plurality of neatly stacked T-shirt bags. The sticky exterior surface enhances the opening of the next successive T-shirt bag during the removal of the front T-shirt bag from the bag dispenser. A suitable first plastic material is low density polyethylene, and a suitable second plastic material is high density polyethylene.

A first electrical charge can be provided on the exterior and interior surfaces of the front panel and the rear panel of a first T-shirt bag, and a second electrical charge can be provided on the exterior and interior surfaces of the front panel and the rear panel of a second T-shirt bag adjacent to the first T-shirt bag. The adjacent T-shirt bags in the bag pack are at different polarities and the front panel and the rear panel of each T-shirt bag are at the same polarity, such that the T-shirt bags are alternately charged. This charging pattern on the T-shirt bags (i) enhances opening of the front T-shirt bag, and (ii) urges opening of the next successive T-shirt bag during removal of the front T-shirt bag from the bag dispenser.

The dispensing system for T-shirt bags allows the bags to be dispensed substantially downwardly by tearing without having to slide the bags horizontally along long support arms as in the known wire racks. This enables the bag dispenser to be formed without such long, obstructive support arms.

An improved system particularly suitable for supporting and dispensing plastic bags commonly known as merchandise bags comprises an improved bag dispenser and an improved merchandise bag for use on the bag dispenser. The merchandise bag has a front panel, a rear panel connected to the front panel, a plurality of laterally spaced apertures formed through the front panel and the rear panel, and a plurality of linearly aligned, laterally spaced slits formed through the front panel and the rear panel below the apertures.

The bag dispenser comprises a mounting base for attaching to a support surface and first laterally spaced bag engaging elements extending from the mounting base for inserting through the apertures of first merchandise bags so as to suspend the first merchandise bags from the mounting base. A first bag supporting member is removably attached to the mounting base. Second laterally spaced bag engaging elements extend from the first bag supporting member for inserting through the apertures of second plastic bags so as to suspend the second merchandise bags from the first bag supporting member.

The bag dispenser can comprise a second bag supporting member removably attached to the mounting base at a location laterally spaced from the first bag supporting member. The second bag dispenser supports third merchandise bags.

The first, second and third merchandise bags can have different panel widths.

The bag supporting members comprise a substantially planar intermediate portion having a front face, and end portions at opposed ends of the intermediate portion. The end portions each have a front face which is rearwardly inclined toward the front face of the intermediate portion. An intermediate bag engaging element extends forwardly from the front face of the intermediate portion, and the intermediate bag engaging element has a shaft and a distal end. An end bag engaging element extends forwardly from the front face of each of the end portions. The end bag engaging elements each have a shaft and a distal end. The distal end of the intermediate bag engaging element and the distal ends of the end bag engaging elements typically lie substantially on an arc, which arc lies in a generally horizontal plane and has a center located forward of the distal ends. This arrangement of the bag engaging elements enhances opening of the merchandise bags during dispensing.

As described above in regard to the T-shirt bags, the merchandise bags can also have a multi-layer construction comprised of layers of different compositions and properties.

The slits formed through the front and rear panels of the merchandise bags are typically provided in a pattern as given in TABLE A hereinbelow. Particularly, the slits are laterally spaced from each other by thin widths of plastic material. The slit pattern is varied depending on the width of the panels. The slit pattern is selected to (i) allow easy opening and removal of the front merchandise bag, and (ii) allow partial opening of the next successive merchandise bag, but to prevent its complete removal from the bag dispenser during removal of the front merchandise bag.

As described above in regard to the T-shirt bags, the merchandise bags are typically provided in bag packs, and electrical charges are typically provided on the exterior and interior surfaces of the merchandise bags.

DRAWINGS

These and other features, aspects and advantages of the present invention will become better understood from the following description, appended claims and accompanying drawings, where:

FIG. 1 is a front perspective view of a bag dispenser in accordance with the present invention;

FIG. 2 is a side elevational view of the bag dispenser of FIG. 1 mounted to a check out;

FIG. 3 is a front perspective view of a bag pack of T-shirt bags in accordance with the present invention;

DESCRIPTION

Figure 4:
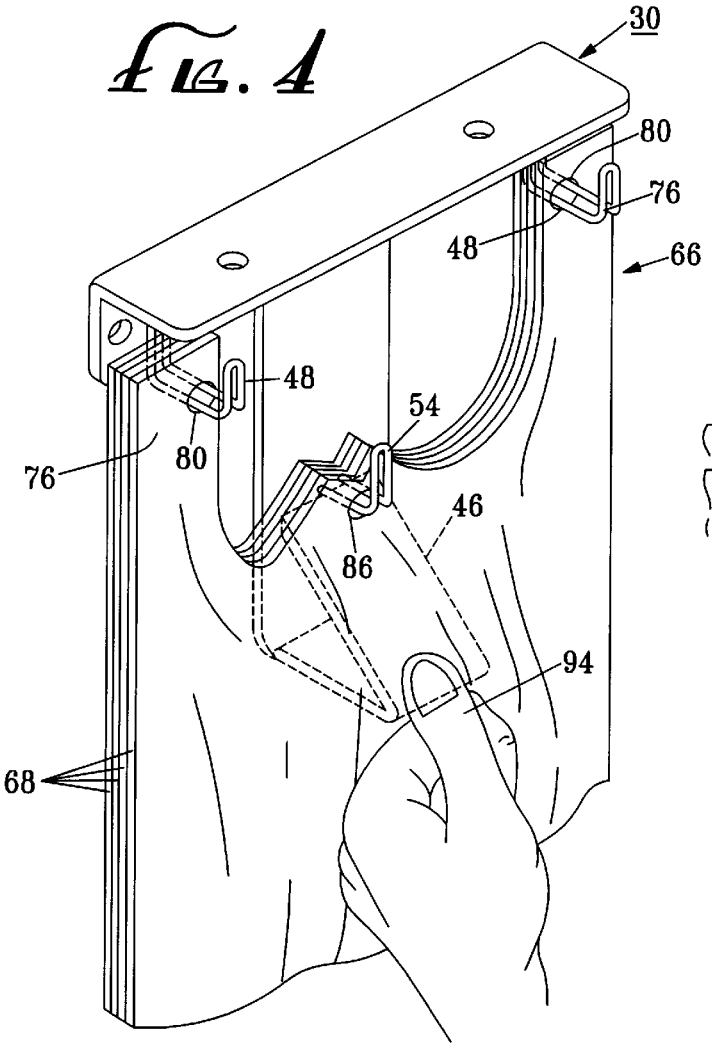
FIG. 4 is an illustrational view showing the manner of initiating the removal of a T-shirt bag of the bag pack of FIG. 3 from the bag dispenser of FIG. 1.

FIG. 1 illustrates a bag dispenser 30 in accordance with the invention. The bag dispenser 30 comprises a mounting portion 32 which is typically substantially L-shaped as shown. The mounting portion 32 includes a vertical wall 34 defining laterally spaced mounting holes 36 therethrough (only one hole is shown), and a horizontal wall 38 defining laterally spaced holes 40 therethrough, for receiving fasteners such as screws (not shown). Other mounting means such as nails or adhesives can alternately be used to fixedly mount the mounting portion 32 to a support surface.

An intermediate portion 42 depends from the vertical wall 34 at approximately the center of the bag dispenser 30. An angular support 44 is provided near the distal end of the intermediate portion 42. The support 44 includes an inclined support wall 46 extending forwardly, downwardly at an acute angle A (FIG. 2) relative to the horizontal. The angle A is typically about 45°. The function of the support wall 46 is described below.

A pair of laterally spaced bag engaging elements such as hooks 48 are provided on the mounting portion 32. The hooks 48 each include a shaft 50 and a distal, upstanding end 52. The distal ends 52 prevent suspended bags from sliding off the hooks 48. The illustrated hooks 48 are generally C-shaped. The hooks 48 can optionally have other shapes. The shafts 50 typically have a length of from about ½ in. to about 2 in.

An intermediate bag engaging element such as an intermediate hook 54 is attached at approximately the center of the intermediate portion 42 above the support wall 46. The intermediate hook 54 includes a shaft 55 and an upstanding distal end 56. The shaft 55 of the intermediate hook 54 typically has a length of from about ½ in. to about 2 in. This length is typically sufficient to support a plurality of T-shirt bags such as in a bag pack.

Referring to FIG. 2, the bag dispenser 30 is constructed to be mountable to a bottom surface 58 of a base 60 of an overhanging top such as a counter 62 typically found in a checkout at a grocery or discount store. The hooks 48, 54 and the support 44 do not extend forward of the front face 64 of the counter 62. Accordingly, the bag dispenser 30 provides no obstructions to persons about the counter 62.

Figure 6:
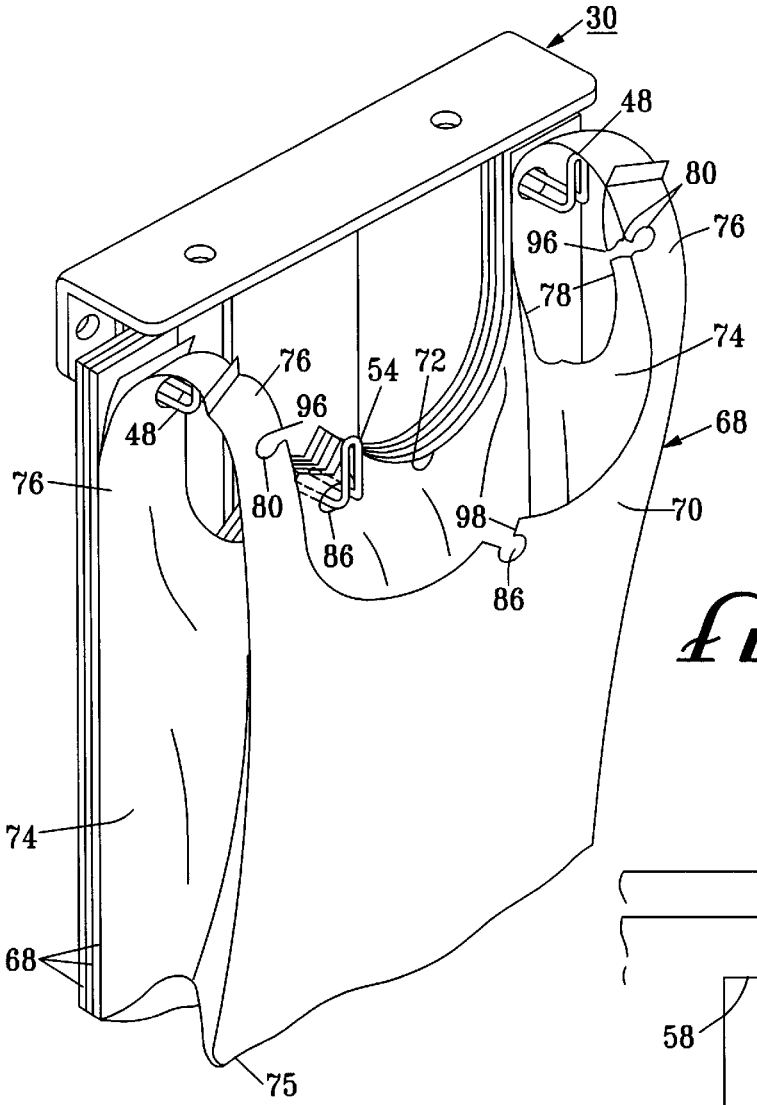
FIG. 6 shows the front bag of the bag pack partially opened.

FIG. 3 illustrates a bag pack 66 comprised of a plurality of T-shirt bags 68 in accordance with the invention. The T-shirt bags 68 are constructed so that the bag pack 66 can be used with the bag dispenser 30 shown in FIG. 1. Referring to FIG. 6, the T-shirt bags 68 include a front panel 70, a rear panel 72, opposed gussets 74 joining the front panel 70 and rear panel 72 to form a closed bottom 75 (FIG. 6), and a pair of laterally spaced handles 76. A gusset fold 78 is formed at the front panel 70 and the rear panel 72 at each handle 76 to provide a double film construction.

Aligned apertures 80 are formed through the front panel 70, the gusset folds 78 and the rear panel 72 of each handle 76 of the T-shirt bag 68. As shown in FIG. 3, the apertures 80 are located proximate to the vertical inner edge 82 of the handles 76 such that there is only a narrow width of material 84 between the vertical inner edge 82 and the apertures 80 at the front panel 70, the rear panel 72 and the gusset folds 78. The material 84 typically has a width of less than about ¼ in. and, preferably, less than about ⅛ in.

Aligned holes 86 are also formed through the front panel 70 and the rear panel 72 of the T-shirt bag 68 between the handles 76, preferably, at approximately the center of the T-shirt bag 68. Proximate to the holes 86, a notch 88 is formed at the horizontal inner edge 90 such that only a narrow width of material 92 separates the holes 86 and the horizontal inner edge 90. The material 92 typically has a width of less than about ¼ in. and, preferably, less than about ⅛ in. As described below, this positioning of the apertures 80 and holes 86 enables the T-shirt bags 68 to be removed from a bag dispenser in a generally downward direction by applying only a small downward force to the T-shirt bags 68. This manner of removal eliminates the need to provide long support arms on the bag dispenser 30 as in known devices.

FIG. 4 shows the bag pack 66 supported on the bag dispenser 30. The T-shirt bags 68 are neatly stacked such that the apertures 80 and the holes 86 in the individual T-shirt bags 68 are aligned with each other. The apertures 80 receive the hooks 48, and the holes 86 in the front panel 70 and the rear panel 72 receive the intermediate hook 54.

Figure 5:
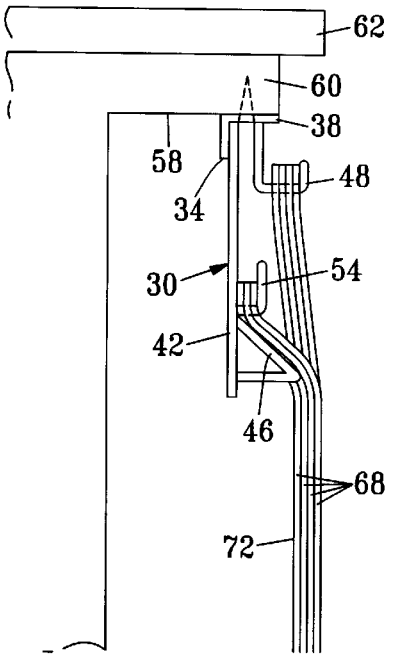
FIG. 5 is a side elevational view of the bag pack of FIG. 3 supported on the bag retainer shown in FIG. 2.

As shown in FIG. 5, the support wall 46 on the intermediate member 42 contacts the rear panel 72 of the rearmost T-shirt bag 68. FIG. 4 depicts an individual using his/her thumb 94 to apply generally downward force to the front panel 70 of the front T-shirt bag 68 at the location of the support wall 46 to initiate the opening of the front T-shirt bag 68.

Figure 7:
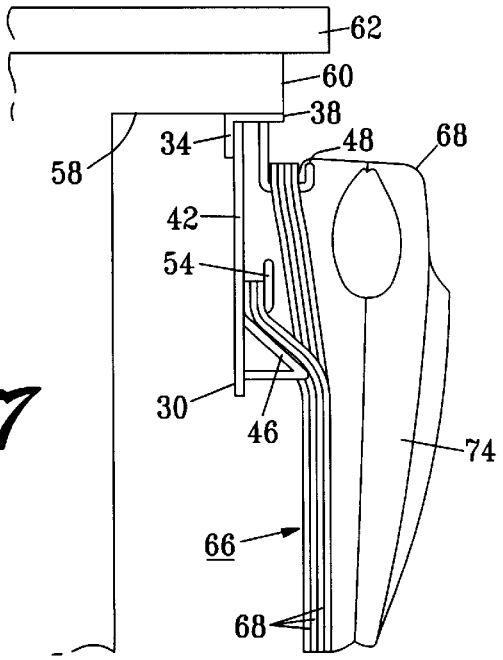
FIG. 7 is a side elevational view of the bag dispenser and bag pack of FIG. 6 as mounted to a bottom surface of a base of a check out.
Figure 8:
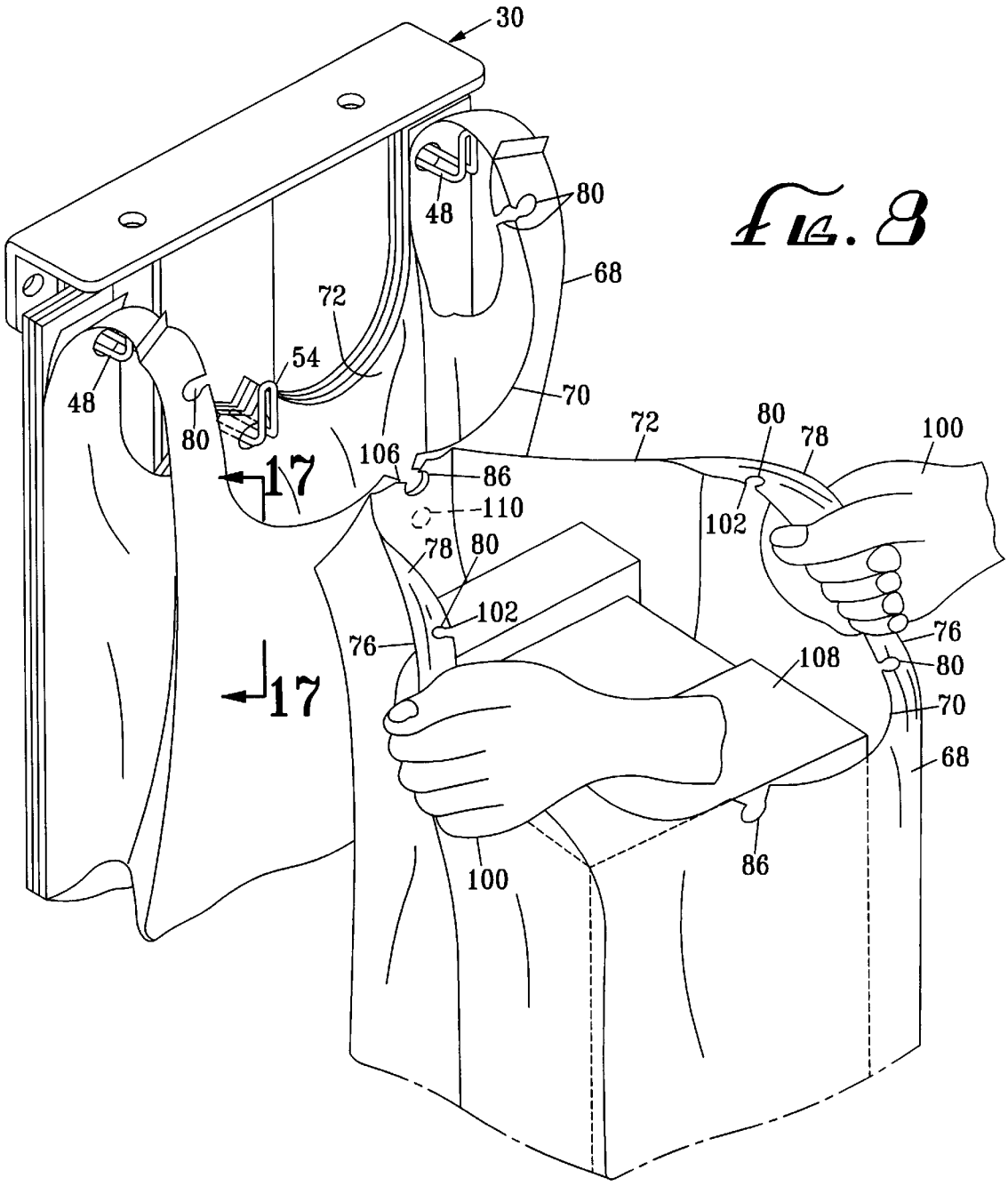
FIG. 8 shows the front bag of FIG. 6 fully opened and loaded and the adjacent bag of the bag pack partially opened.

FIGS. 6–8 depict the manner of opening and removing the front T-shirt bag 68 from the bag dispenser 30. FIG. 6 shows the front T-shirt bag 68 partially open after generally downward force is applied to form tears 96 through the material 84 in communication with the apertures 80 in the front panel 70 and the associated gusset folds 74, and to form a tear 98 through the material 92 in communication with the hole 86 in the front panel 70.

FIG. 7 illustrates the bag pack 66 supported in a substantially vertical orientation on the bag dispenser 30 as shown in the FIG. 6, with the bag dispenser 30 mounted to the bottom surface 58 of the base 60.

FIG. 8 depicts an individual's hands 100 grasping the handles 76 of the front T-shirt bag 68 which is removed from the bag dispenser 30. As shown, complete removal of the front T-shirt bag 68 is effected by forming tears 102 in communication with the apertures (not shown) in the rear panel 72 and the associated gusset folds 78, and a tear 106 in communication with the hole 86 in the rear panel 72. Items 108 such as groceries are loaded in the removed T-shirt bag 68.

As also shown in FIG. 8, removal of the front T-shirt bag 68 causes the next adjacent T-shirt bag 68 to be pulled partially opened. The front T-shirt bag 68 and the next adjacent T-shirt bag 68 are retained together in this condition by a cold weld 110. A small force is applied to break the cold weld 110 and completely separate the two T-shirt bags 68 from each other (not shown).

Figure 9:
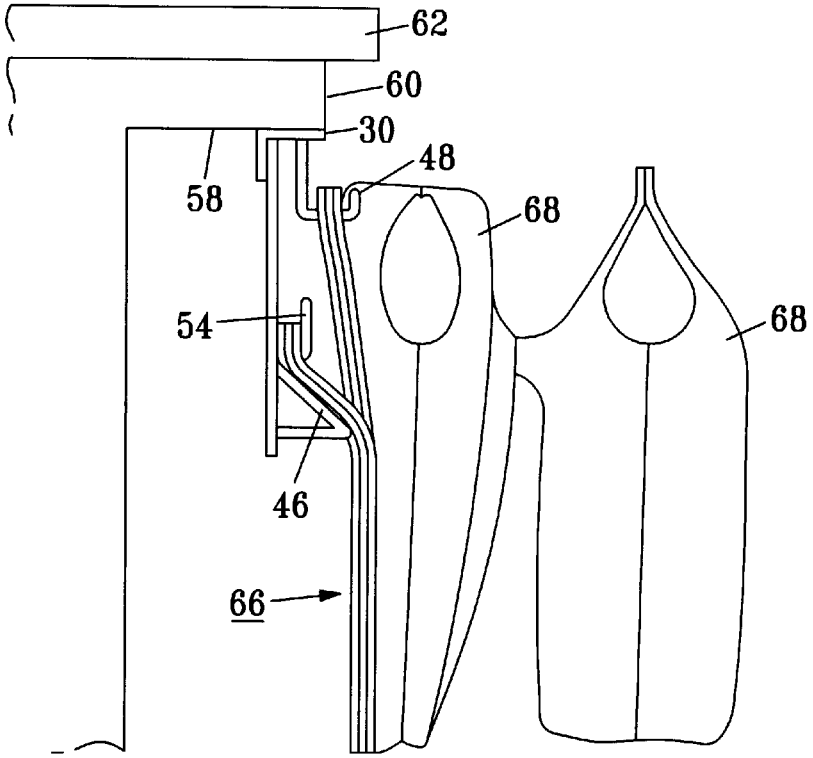
FIG. 9 is a side elevational view of the bag dispenser and bag pack of FIG. 8 as mounted to a bottom surface of a base of a check out.

FIG. 9 illustrates the bag pack 66 of FIG. 8 supported in a substantially vertical orientation on the bag dispenser 30 mounted to the bottom surface 58 of the base 60.

Figure 10:
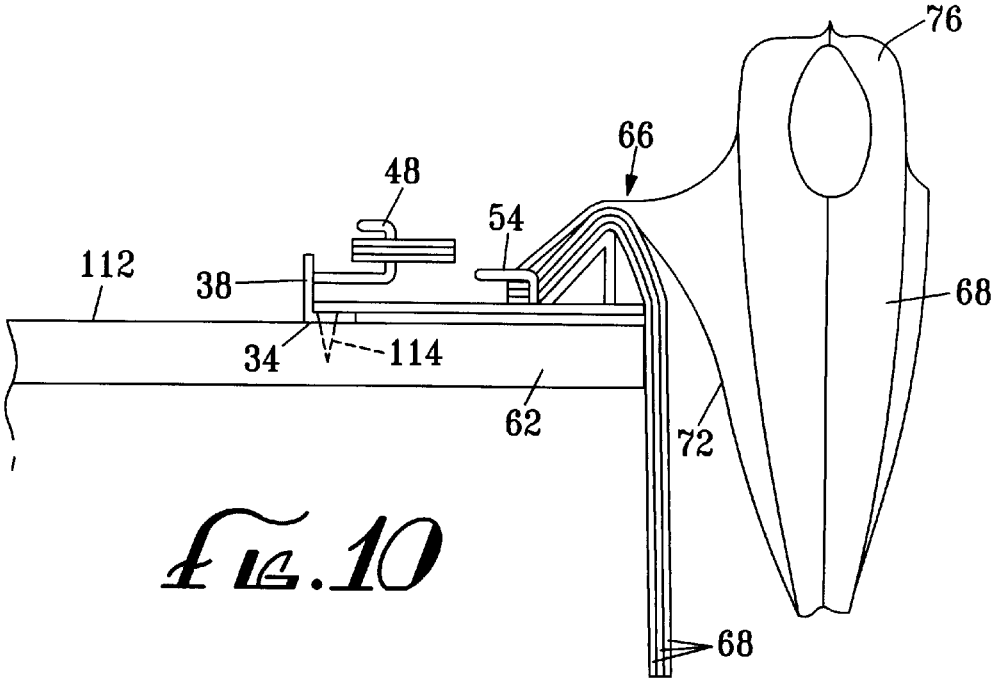
FIG. 10 illustrates the bag dispenser and bag pack of FIG. 6 with the bag dispenser mounted horizontally to a top surface of a checkout counter and the front bag of the bag pack opened.

FIG. 10 shows the bag pack 66 supported on the bag dispenser 30 as mounted horizontally to the top surface 112 of the counter 62. The front T-shirt bag 68 is shown in an opened condition. The remaining T-shirt bags 68 of the bag pack 66 partially depend from the counter 62. The front T-shirt bag 68 is removed from the bag dispenser 70 by applying a generally horizontally directed force to the front T-shirt bag 68 to form tears (not shown) in communication with the apertures 80 and hole 86 to remove the T-shirt bag 68 from the hooks 48, 54. In the illustrated position, the front T-shirt bag 68 is maintained on the bag dispenser 30 by engagement of the hook 54 with the rear panel 72.

It will be understood by those skilled in the art that the bag dispenser can also be used in a horizontal orientation as shown in FIG. 10 while supported on, but not fastened to, a supporting surface such as the surface 112.

Figure 17:
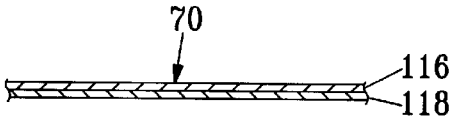
FIG. 17 is a cross-sectional view in the direction of line 17—17 of FIG. 8 showing the multi-layer construction of a panel of a T-shirt bag.

The T-shirt bag 68 preferably has a multi-layer construction such as shown in FIG. 17. For example, the T-shirt bag 68 can comprise two layers 116, 118, which can be selectively formed of different plastic materials having different properties. For example, for T-shirt bags having layers of at least two different compositions, at least one layer can be formed of a suitable plastic material that provides a sticky exterior texture and high tear strength, and at least one other layer can be formed of a suitable plastic material that has high tensile strength such that the T-shirt bags have good tensile strength, good tear strength and a sticky exterior surface texture.

A suitable plastic material is a polyethylene such as NOVAPOL™, commercially available from Novacar. Polyethylene materials are typically classified as being either high or low density. Low density polyethylene materials are typically classified as having a density of from about 0.91 to about 0.94, and high density polyethylene materials as having a density greater than about 0.94. NOVAPOL™ has a density of about 0.92 is classified as a low-density polyethylene. This material has a relatively sticky exterior surface texture and also provides tear strength to the T-shirt bag 68. Tear strength is measured in accordance with American Society for Testing and Materials (ASTM) standard D1922. Another suitable material is a polyethylene such as ALATHON™, commercially available from Lyondell Petrochemical Company of Houston, Tex. This material provides enhanced tensile strength to the T-shirt bag 68. Tensile strength is measured in accordance with ASTM standard D882. This material has a density of about 0.95 and is classified as a high-density polyethylene. Materials having suitable properties other than the above-described polyethylene materials can be used to form the T-shirt bag 68.

Referring to FIG. 8, the layer 118 of the front panel 70 faces the front T-shirt bag 68 and is typically formed of a low density polyethylene material, and the layer 116 faces the rear panel 72 of the T-shirt bag 68 and is typically formed of a high density polyethylene. For the rear panel 72, the layer (not shown) which faces the next adjacent T-shirt bag 68 of the bag pack 66 is formed of the low density polyethylene, and the other layer of the rear panel 72 which faces the front panel 70 is formed of the high density polyethylene. The texture of the low density polyethylene enhances adhesion between the adjacent T-shirt bags 68 of the bag pack 66 so as to assist in the opening of the next adjacent T-shirt bag 68 during removal of the front T-shirt bag 68 from the bag dispenser 30.

The T-shirt bags 68 can be opaque and selectively colored, or clear. Clear T-shirt bags can be used, for example, as produce bags.

The bag packs 66 are preferably formed in accordance with the method described in U.S. patent application Ser. No. 08/130,310, incorporated herein by reference. The method comprises inducing an alternating static charge on the T-shirt bags 68 by inducing a first charge (positive or negative) on the exterior and interior surfaces of both the front panel 70 and the rear panel 72 of a first T-shirt bag 68, an by inducing a second charge (positive or negative) on the exterior and interior surfaces of both the front panel 70 and the rear panel 72 of a second T-shirt bag 68 adjacent to the first T-shirt bag 68. The exterior surfaces of adjacent T-shirt bags 68 in the bag pack 66 are at different polarities so as to attract each other, and the front panel 70 and the rear panel 72 of each T-shirt bag 68 are at the same polarity so as to repel each other, to form a series of alternatively charged T-shirt bags.

The like charges provided on the interior surfaces of the front panel 70 and the rear panel 72 of each T-shirt bag promote easy opening of the T-shirt bags 68. The opposite charges provided on the exterior surfaces of the front panel 70 and the rear panel 72 of the adjacently stacked T-shirt bags 68 attract each other, so that when a T-shirt bag 68 is pulled from the bag pack 66, the adjacent next T-shirt bag 68 is partly opened for easier loading.

Referring to FIG. 8, the exterior surfaces of the T-shirt bags 68 are preferably cold welded together by one or more cold welds 108 as described in U.S. patent application Ser. No. 08/130,310 to further enhance the opening of the adjacent next T-shirt bag 68 of the bag pack 66. Typically, a plurality of laterally spaced cold welds 108 are used.

For T-shirt bags 68 comprising two or more layers as shown in FIG. 17, the charge induced on the exterior surface of each of the front panel 70 and rear panel 72 are reduced for layers formed of a low density polyethylene or the like as compared to T-shirt bags 68 comprising front panel 70 and rear panel 72 outer layers formed of a high density polyethylene or the like. A lesser charge is applied to the low density polyethylene because its sticky texture enhances adhesion between the exterior surfaces of adjacent T-shirt bags in the bag pack, and so a lesser charge needs to be induced on the exterior surfaces to ensure that the next adjacent T-shirt bag in the bag pack is pulled open each time a T-shirt bag is removed from the bag pack.

Figures 11, 12:
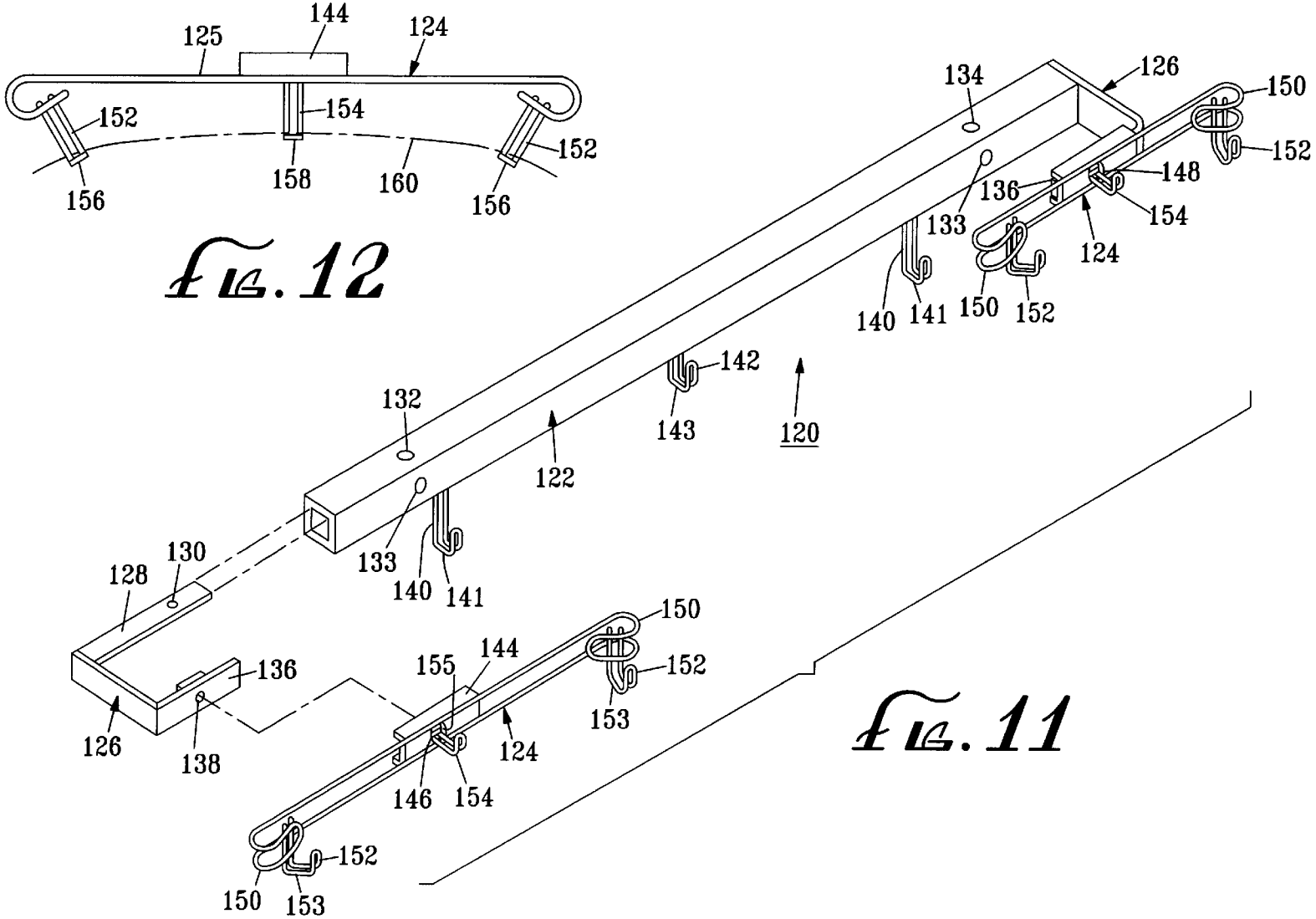
FIG. 11 is an exploded view of a bag dispenser according to another embodiment of the invention.
FIG. 12 is a top view of one of the bag supporting members of the bag dispenser of FIG. 11, illustrating the arrangement of the distal ends of the hooks substantially on an arc lying in a generally horizontal plane.
Figure 13:
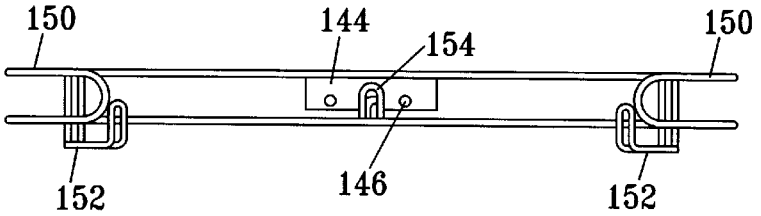
FIG. 13 is a front view of the bag supporting member of FIG. 12 illustrating the hooks at the ends of the member positioned below the intermediate hook.

FIGS. 11–13 illustrate an alternate embodiment of a bag dispenser 120 suitable for dispensing merchandise bags. The bag dispenser 120 comprises a tubular mounting base 122 and one or more bag supporting members 124 which are selectively attachable to the mounting base 122. The mounting base can be fixedly mounted to a support surface (not shown) by mounting means such as fasteners 133. Other suitable fasteners such as nails and adhesives can alternately be used. The bag supporting members 124 are attached at opposed ends of the mounting base 122 by connecting brackets 126. The illustrated connecting brackets 126 are generally L-shaped and comprise a portion 128 which is inserted inside of the mounting base 122 such that a hole 130 in the portion 128 is aligned with a hole 132 formed in the mounting base 122. A fastener 134 is inserted through the aligned holes 130, 132 as shown for the right bag supporting member 124 in FIG. 11 to attach the bag supporting members 124 to the mounting base 122. The connecting brackets 126 each also comprise a front portion 136 defining a hole 138.

A plurality of bag engaging elements such as hooks 140, 142 are provided on the mounting base 122. The hooks 140, 142 have shafts 141, 143, respectively, which are each typically from about ½ in. to about 2 in. long. This length typically is sufficient to support at least one bag pack of merchandise bags. The hooks 140 depend below the hook 142. The spacing between the hooks 140 and 142 can be varied to support bags having different panel widths.

The illustrated bag supporting members 124 have a wire construction. Other constructions such as solid plate can optionally be used. A generally U-shaped mounting piece 144 is disposed centrally of the bag supporting members 124 at a substantially planar, intermediate portion 125. The mounting piece 144 receives the front portion 136 of the connecting bracket 126. The mounting piece 144 defines at least one hole 146. A fastener 148 is inserted through the holes 138, 148 to attach the bag supporting member 124 to the connecting bracket 126. The bag supporting members 124 comprise arcuate shaped, rearward directed, end portions 150. A bag engaging element such as a hook 152 having a shaft 153 is provided at each of the end portions 150. A hook 154 having a shaft 155 is provided on the mounting piece 144. The shafts 153, 155 of the hooks 152, 154, respectively, typically have a length of from about ½ in. to about 2 in. The bag supporting members 124 can be provided with different spacings between the hooks 152 and 154 to support different sized merchandise bags.

FIG. 12 illustrates the arrangement of the distal ends 156, 158 of the hooks 152, 154, respectively, of one of the bag supporting members 124. The distal ends 156, 158 lie substantially on a common arc 160. The arc 160 lies in a generally horizontal plane and has a center (not shown) located forward of the distal ends 158, 160. The hooks 152, 154 on the right bag supporting member 124 are also arranged in this same configuration. This arrangement of the hooks 152, 154 is believed to urge suspended merchandise bags open during removal from the bag dispenser 120. This enables the merchandise bags to be more easily loaded by individuals without having to struggle to separate the front panel 170 from the rear panel 172.

FIG. 13 illustrates the positioning of the hooks 152 below the hook 154.

The bag supporting members 124 can be used independent of the mounting base 122 and attached directly to a supporting surface (not shown) by inserting a suitable fastener such as a screw through the hole 146 in the mounting piece 144 and into the supporting surface. The mounting piece 144 can be formed as a flat plate (not shown) to enable such attachment.

Figure 14:
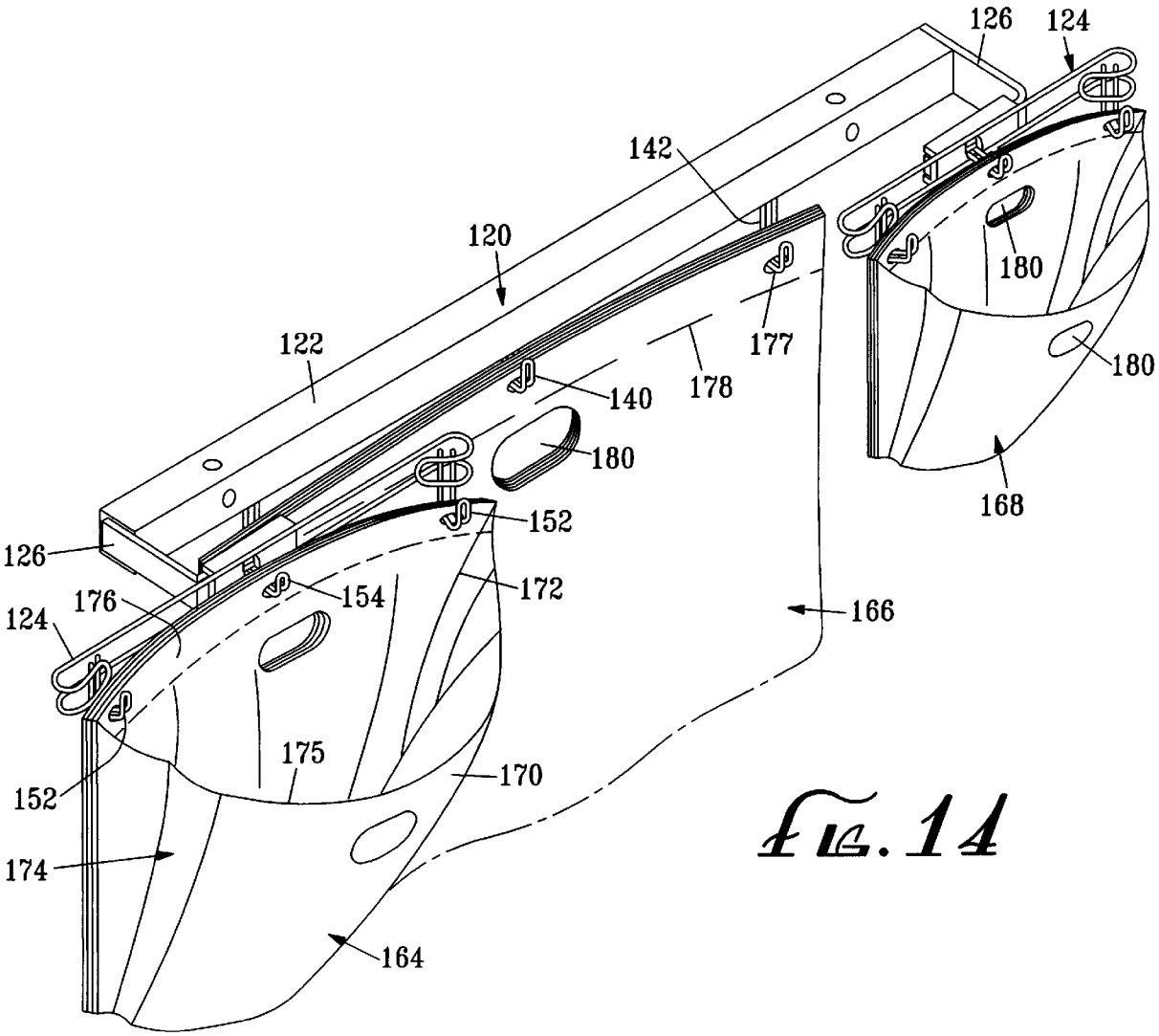
FIG. 14 illustrates bag packs of different sized merchandise bags mounted on the bag dispenser of FIG. 11, with two front bags being opened, the hooks extend through apertures in the bags.

FIG. 14 illustrates three different sizes of merchandise bags 164, 166, 168 according to the present invention suspended on the bag dispenser 120. Front merchandise bags 164, 168 are shown in the opened condition. The merchandise bags 164, 166, 168 are bottom sealed and comprise a front panel 170 and a rear panel 172 joined by side gussets 174. The merchandise bags do not include handles. The intermediate merchandise bags 166 are wider than the bags 164 and 168. Different bag sizes can be used on the bag dispenser depending on the spacing of the hooks 140, 142 of the mounting base 122, and the hooks 152, 154 of the bag supporting members 124.

Figure 16:
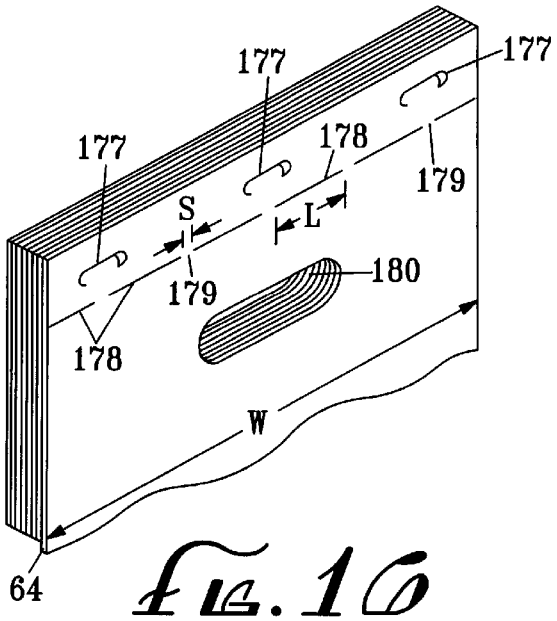
FIG. 16 is a partial view of a bag pack of merchandise bags according to the present invention showing the arrangement of the slits in the bags.
Figure 15:
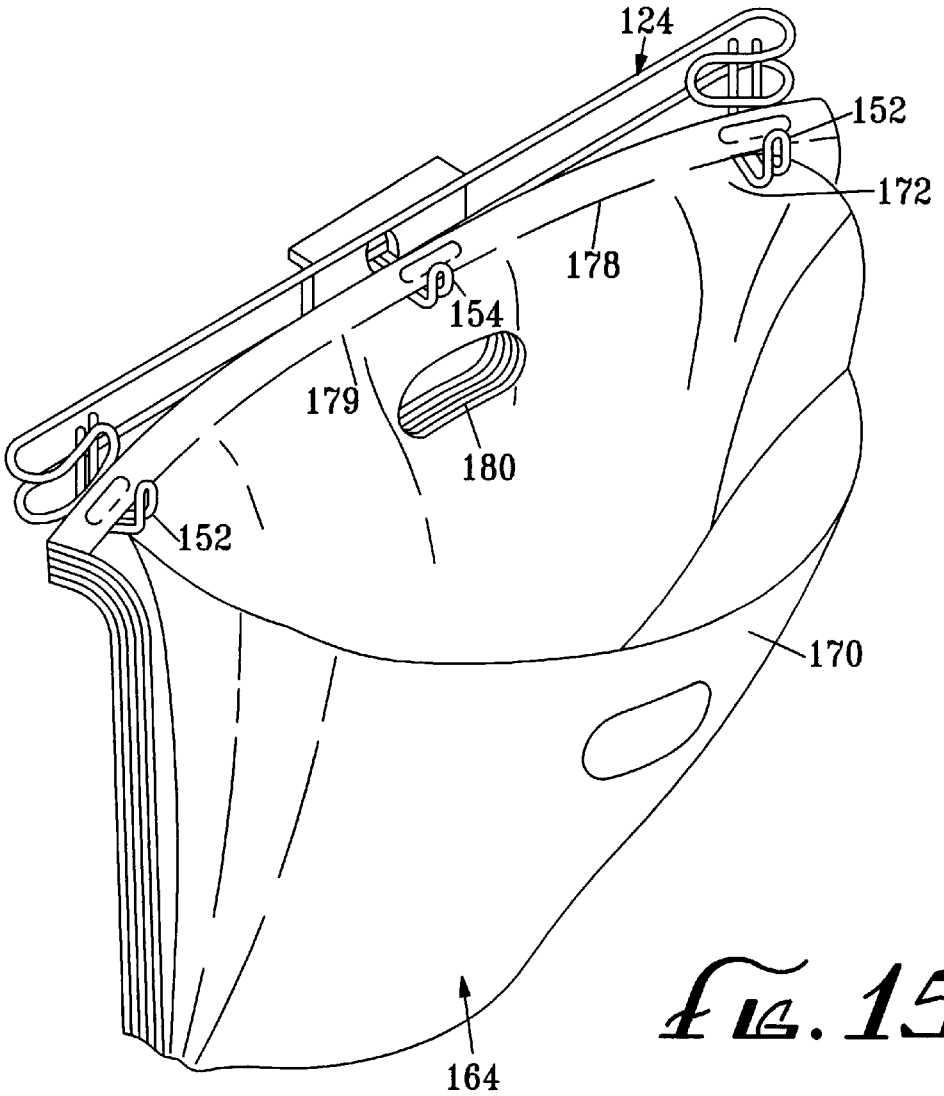
FIG. 15 shows a merchandise bag pack mounted on a bag supporting members, the hooks extend through slits.

As shown in FIGS. 14–16, a plurality of laterally spaced, hook receiving, apertures 177 are formed through the front panel 170 and the rear panel 172 of the merchandise bags 164 proximate the upper end 180. The apertures 177 are sized and relatively spaced to receive the hooks 140, 142 and to receive the hooks 152, 154. A plurality of laterally spaced, substantially linearly aligned slits 178 are formed through the front panel 170 and the rear panel 172 below the apertures 177. The merchandise bags 164 are removed from the bag dispenser 120 by severing the narrow width of material 179 between the slits 178 such that the header portion 176 remains on the hooks 152, 154 of the mounting base 122 and the bag supporting member 124.

Referring to FIG. 15, the merchandise bags 164 can optionally be suspended from the bag dispenser 120 by inserting the hooks 152, 154 through the slits 178.

Referring to FIG. 16, the length L of the slits 178 and the spacing S between the slits 178 is selected to enable the merchandise bags 164 to be easily torn from the bag dispenser 120, and also to prevent the next adjacent merchandise bag 164 from being torn completely from the bag dispenser 120 when the front merchandise bag 164 is removed from the bag dispenser 120. That is, when the front merchandise bag 164 is completely removed, the front panel (not shown) of the next merchandise bag 164 is severed, but the rear panel (not shown) is not severed (as shown for the front merchandise bag 164 in FIG. 14), so that the next merchandise bag 164 is retained on the bag dispenser 120 in the opened condition. If the rear panel of the next merchandise bag 164 is too easily severed, then multiple merchandise bags can be dispensed simultaneously. In addition, the number of spacings S is selected such that the top edge 175 of the merchandise bags 164 (FIG. 14) has a generally uniform, straight contour after removal, and does not have an unsightly, jagged appearance.

The spacing S between the slits 168 is typically less than about 1/16 in. The length S of the slits 168 varies across the width of the front panel 170 and the rear panel 172. TABLE A below gives the typical slit pattern for merchandise bags of various panel widths W according to the present invention. The slit pattern is typically substantially the same in the front panel and the rear panel.

TABLE A

| Bag | Panel Width, W (in) | Slit Length, L, Pattern Across Panel Width (And Gussets) (in)[1] |
|---|---|---|
| A | 8–19 | 1-1-2-2½-2-1-1 |
| B | 11–13 | 1-2-2½-2½-2½-2-1 |
| C | 13–16 | 1-2½-2½-2½-2½-2½-1 |
| D | 20–24 | 1-1-2-2½-2½-2½-2½-2½-2½-2½-2-1-1 |

[1]The hyphen "-" between the slit lengths L represents a space S of material having a width of about 1/16 in.

As shown in TABLE A, merchandise bags A, B and C each have the same number of slits (7) and material spacings S (6) between the slits. The length L of the slits varies for bags A, B and C. Bag D has a greater number of slits (13) and a greater number of material spacings (12) between the slits.

For bags A and B, the total length of the slits exceeds the panel width. The 1 in. slits at opposed sides of the front and rear panels extend partially into the gussets of the merchandise bags. Preferably, a relatively lower total slit width and relatively more spacings S are formed in the gusset area of the merchandise bags to provide additional plastic material there to create resistance to tearing so that the next merchandise bag in the bag pack is not removed from the bag dispenser along with the front merchandise bag.

According to the present invention, the bag packs of merchandise bags are preferably charged as described above in regard to the bag packs 66 of the T-shirt bags 68. These charges further assist in the opening of the merchandise bags during their removal from the bag dispenser 120.

The merchandise bags can also have a multi-layer construction as described in regard to the T-shirt bags 68.

One or more cold welds are preferably formed on the merchandise bags of the bag pack to assist in the opening of the next adjacent bag of the bag pack during removal of the front merchandise bag.

The bag dispenser 120 is highly versatile. Simply by removing a bag pack of merchandise bags of one size and then substituting a bag supporting member 124 with hooks 152, 154 having a first spacing, with a bag supporting member 124 having hooks 152, 154 of a second spacing, a bag pack of merchandise bags of a different panel width and aperture 177 spacing can be readily replaced on the bag dispenser 120. The bag dispenser 120 allows the proper sized bag for a given application to be used, and thus enables significant cost savings on bags.

Additional holes 132 can be formed in the mounting base 122 to enable the bag supporting members 124 to be laterally adjusted relative to the mounting base 122 (not shown). In this manner, the positions of the supported merchandise bag packs can be varied with respect to each other and to the mounting base 122. This feature enables the bags to be positioned so as to be easily accessible to baggers and also not be an obstruction.

The bag dispensers 30 and 120 can be formed of suitable metals such as steel and aluminum, as well as plastics.

Although the present invention has been described in considerable detail with reference to certain preferred versions thereof, other versions are possible. Therefore, the scope of the appended claims should not be limited to the description of the preferred versions contained herein.

What is claimed is:

1. A bag pack comprising a plurality of plastic bags secured together for use on a bag dispenser having a plurality of laterally spaced apart bag engaging elements, each bag comprising:

(a) a front panel having a central portion and peripheral edges;

(b) a rear panel connected to the front panel so as to form a closed bottom and an open top, the rear panel having a central portion and peripheral edges;

(c) a plurality of laterally spaced apart apertures formed through the front panel and the rear panel, the apertures being sized and shaped relative to each other to each receive one of the bag engaging elements to suspend the merchandise bag from the bag dispenser; and (d) a plurality of substantially aligned, laterally spaced apart slits extending through the front panel and the rear panel below the apertures;

wherein the front and rear panels have a width and the slits have a corresponding slit length pattern across the front and rear panels effective to allow easy opening and removal of a forwardmost bag from the bag dispenser, while allowing partial opening of the next successive bag without complete removal of a next successive bag from the bag dispenser, and wherein the effective slit pattern includes at least two different lengths of slits with a relatively longer slit and a relatively shorter slit, the relatively longer slit being closer to the central portion of the front and rear panels than is the relatively shorter slit.

2. The bag pack of claim 1, wherein the front panel and rear panel of the bags each comprises a first layer having an exterior surface and a second layer on the first layer, the first layer is composed of a first plastic material and the second layer is composed of a second plastic material, the first plastic material has a first tear strength, a first tensile strength and a sticky exterior texture, the second material has a second tear strength and a second tensile strength, the first tear strength being greater than the second tear strength, and the second tensile strength being greater than the first tensile strength.

3. The bag pack of claim 2, wherein the first plastic material is low density polyethylene and the second plastic material is high density polyethylene.

4. The bag pack of claim 3, wherein a first charge is provided on the exterior and interior surfaces of the front panel and the rear panel of a first bag, and a second charge is provided on the exterior and interior surfaces of the front panel and the rear panel of a second bag adjacent to the first bag, the adjacent bags are at different polarities and the front panel and the rear panel of each bag are at the same polarity, such that the bags are alternately charged.

5. The bag pack of claim 1 comprising slits of at least three different lengths, where each slit is as long as or longer than any slit closer to the peripheral edge of the front panel and the rear panel.

6. The bag pack of claim 1 wherein the length of the material between adjacent slits is about 1/16 inch.

7. The bag pack of claim 1, wherein the panels have a width of 8 to 10 inches and the slit lengths across the panels in inches, are 1-1-2-2½-2-1-1.

8. The bag pack of claim 1, wherein the panels have a width of 11 to 13 inches and the slit lengths across the panels in inches, are 1-2-2½-2½-2½-2-1.

9. The bag pack of claim 1, wherein the panels have a width of 13 to 16 inches and the slit lengths across the panels in inches, are 1-2½-2½-2½-2½-2½-1.

10. The bag pack of claim 1, wherein the panels have a width of 20 to 24 inches and the slit lengths across the panels in inches, are 1-1-2-2½-2½-2½-2½-2½-2½-2½-2-1-1.

11. The bag pack of claim 1, wherein a first charge is provided on the exterior and interior surfaces of the front panel and the rear panel of a first bag, and a second charge is provided on the exterior and interior surfaces of the front panel and the rear panel of a second bag adjacent to the first bag, such that the adjacent bags are at different polarities and the front panel and the rear panel of each bag are at the same polarity, and such that all the bags of the bag pack are alternatively charged to facilitate the opening of each bag as it is torn from the bag pack and to facilitate the opening of the bag succeeding the bag torn from the pack.

12. A bag pack, comprising a plurality of plastic bags secured together, each bag comprising:

(a) a front panel having a central portion and peripheral edges;

(b) a rear panel having a central portion and peripheral edges;

(c) wherein the edges of the front and rear panels are connected to form an open top and a closed bottom; and (d) a plurality of substantially aligned, laterally spaced apart slits of at least two different lengths extending through the front panel and rear panel, with a relatively longer slit closer to the central portion of the front and rear panels and a relatively shorter slit closer to the edges, such that when a forwardmost bag is removed from the bag pack, a next successive bag in the bag pack is not pulled completely off the bag pack, and wherein each panel of each bag comprises a first layer having an exterior surface and a second layer on the first layer, the first layer is comprised of a first plastic material having a first tear strength, a first tensile strength, and a sticky texture, and the second layer is comprised of a second plastic material having a second tear strength and a second tensile strength, such that when the forwardmost bag is removed from the bag pack, the next successive bag in the bag pack is pulled open.

13. The bag pack of claim 12, wherein the first tear strength is greater than the second tear strength, and the second tensile strength is greater than the first tensile strength.

14. The bag pack of claim 13, wherein the first plastic material is low density polyethylene and the second plastic material is high density polyethylene.

15. The bag pack of claims 7, 8, 9, 10, 12 wherein the spacing between slits on the front and rear panels is equal to or less than one-sixteenth (1/16) of an inch.

16. A merchandise bag system for use on a bag dispenser having a plurality of laterally spaced bag engaging elements, the merchandise bag system comprising a plurality of merchandise bags, each merchandise bag including:

a) a front panel;

b) a rear panel connected to the front panel so as to form a closed bottom and a top, the front and rear panels having peripheral edges and a central portion;

c) a plurality of laterally spaced apertures formed through the front panel and the rear panel, the apertures being sized and spaced relative to each other to each receive one of the bag engaging elements to suspend the merchandise bag from the bag dispenser; and d) a plurality of substantially aligned, laterally spaced slits extending through the front panel and rear panel below the apertures;

wherein the slits have a slit length pattern effective to (i) urge a front merchandise bag open during dispensing from the bag dispenser, and (ii) prevent complete removal of a next successive merchandise bag from the bag dispenser during dispensing of the front merchandise bag, the slit length pattern having each slit at least as long as the adjacent slit closer to the peripheral edge and at least two slits being of different length.

17. The bag pack of claim 1, 2, 12 or 16 comprising one or more cold welds formed on the bags to assist in opening the next successive bag in the back pack during removal of the forwardmost bag.

18. The bag pack of claim 1 or 16 wherein the slits are at least one inch in length.

19. The bag pack of claim 1 wherein the relatively longer slit is two and a half times longer than the relatively shorter slit.

20. The bag pack of claim 16 wherein the space between slits on the front and rear panels is equal to or less than one-sixteenth (1/16th) of an inch.

* * * * *